United States Patent [19]

Lange et al.

[11] 4,321,890

[45] Mar. 30, 1982

[54] SURGICAL RESTRAINER FOR ANIMALS

[75] Inventors: Richard L. Lange; Randall L. Lange, both of Knoxville, Tenn.

[73] Assignee: Mark Anderson, Elmwood, Wis.

[21] Appl. No.: 209,380

[22] Filed: Nov. 24, 1980

[51] Int. Cl.[3] ..... A61D 3/00

[52] U.S. Cl. ..... 119/96; 119/103; 128/133

[58] Field of Search ..... 119/96, 103; 128/133, 128/134; 17/44, 44.1, 44.2, 44.3

[56] References Cited

U.S. PATENT DOCUMENTS

| | | | |
|---|---|---|---|
| 1,987,977 | 1/1935 | Shannon | 119/103 |
| 2,564,630 | 8/1951 | Thorman | 17/44.1 |
| 3,137,273 | 6/1964 | Greenwood | 119/103 |
| 3,368,564 | 2/1968 | Selix | 128/133 |
| 3,496,935 | 2/1970 | Bell, Jr. | 119/96 |

*Primary Examiner*—Jay N. Eskovitz
*Attorney, Agent, or Firm*—Edward H. Loveman

[57] ABSTRACT

A surgical restrainer for an animal has a striplike structure including a central flat bottomed band with inverted V-shaped legs at opposite ends defining loops to receive forearms of an anesthetized animal resting in supine position on said band and cradled between said legs, so that the animal cannot roll over during surgery and post-operatively.

9 Claims, 12 Drawing Figures

SURGICAL RESTRAINER FOR ANIMALS

This invention relates to restrainer devices for animals during surgery, and more particularly, concerns a restrainer device for holding animals, such as dogs and cats, during surgery and immediately post-operatively.

Heretofore, when animals were prepared for surgery requiring ventrodorsal exposure, it has been conventional to secure the animals to the surgical table by leather or fabric tie-down straps, to prevent them from rolling over during the surgical procedures. This method has a number of disadvantages. When animals are tied down, their breathing is impaired. Also it is time consuming to secure a plurality of strings or straps to the animal. Another objection is that the animal cannot be transported from the surgical table until the tie-down straps are released, and then the animal is free to roll over during the immediate post-operative recovery stage. Since this condition is untenable, the animal must be secured to the recovery table or bed by straps.

The present invention is directed at overcoming the above, and other difficulties, disadvantages and objections of prior surgical restraints for animals.

According to the invention, there is provided a surgical restrainer having a central band defining a cradle to contain an animal in supine position. The back and sides of the animal are partially enclosed. Integral with the opposite ends of the cradle are two inverted V-shaped or U-shaped legs, defining tapered loops which receive forearms of an animal resting on the central band. The legs have flat feet which are coplanar with each other and with the bottom of the central band to define a stable structure which cannot roll over in any direction when an anesthetized animal is disposed in the restrainer.

It is, therefore, a principal object of the present invention is to provide a surgical restrainer made of metal, plastic, or other suitable material formed with a wide central band to underlie the back of a supine animal, with a lateral bent leg at opposite ends thereof, defining loops to receive forearms of the animal.

Another object of the present invention, is to provide a surgical restrainer as described, with a contoured or curved lining in the central band shaped to receive snugly the back of the animal.

A further object of the present invention, is to provide a surgical restrainer as described, arranged so that a plurality of restrainers of different sizes can be provided for accomodating animals of different sizes.

Another object of the present invention, is to provide surgical restrainers as described, so shaped that a plurality of restrainers of the same or different sizes can be nested inside one another to occupy minimum storage space.

A further object of the present invention, is to provide a surgical restrainer as described, wherein, the central band is formed of two telescopic parts for adjusting the size of the restrainer.

These and other objects and many of the attendant advantages of this invention will be readily appreciated as the same becomes better understood by reference to the following detailed description when considered in connection with the accompanying drawings in which.

Figure 5:
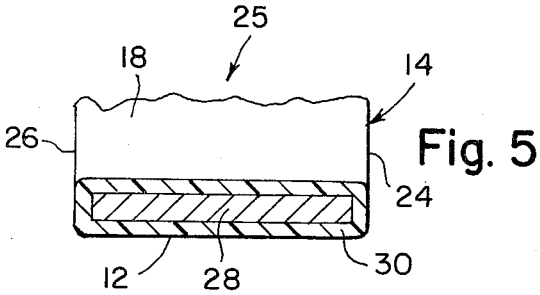
FIG. 5 is an enlarged fragmentary cross sectional view of the restrainer taken along line 5—5 of FIG. 3.
Figure 1:
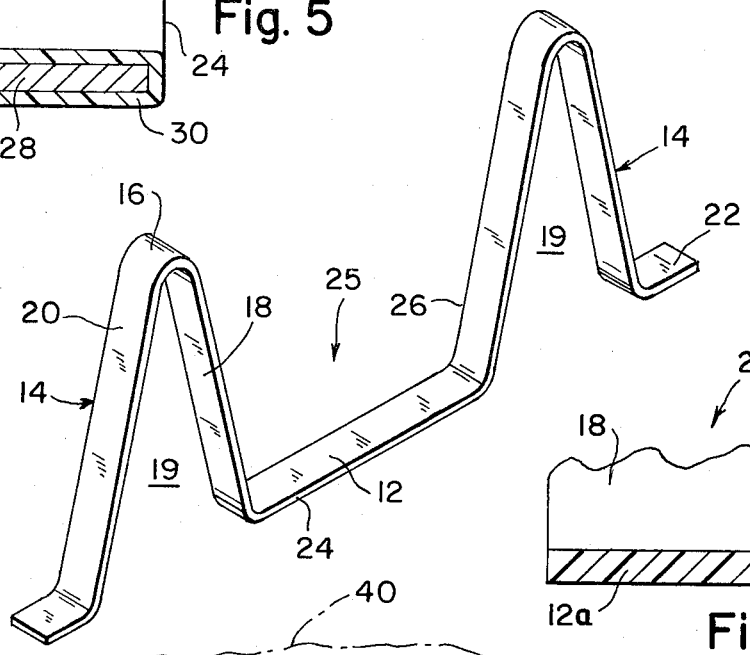
FIG. 1 is a perspective view of an animal restrainer embodying the present invention.

Referring now to the drawings, wherein, like reference characters designate like or corresponding parts throughout, there is illustrated in FIGS. 1-5, a surgical restrainer generally designated as reference numeral 25 in the form of a rigid strip bent to define a long central band 12. At opposite ends of the band 12, are two integral legs 14. Each of the legs 14, have an inverted V-shape or U-shape with a rounded bight 16 uppermost defining, a tapered loop 19. A pair of side walls 18 and 20, of the legs 14, flare apart downwardly. The lower end of each of the walls 18 is integral with one end of the band 12. Integral with the lower end of each of the outer walls 20 is a flat foot 22. The feet 22 and the band 12 are all coplanar. The restrainer 25 has coplanar front edges 24, parallel to coplanar rear edges 26. The entire width W of the restrainer 25 may be one to two inches so that it can stand upright by itself on a flat surface. The restrainer 25 may be made with an inner metal core 28 of metal such as steel or aluminum and an outer coating 30 of plastic such as vinyl or polyethylene; see FIG. 5.

Figure 6:
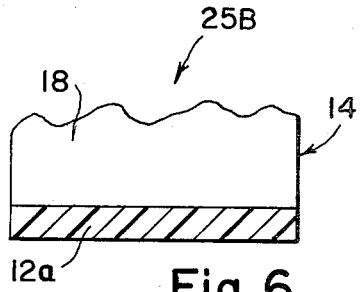
FIG. 6 is a sectional view similar to FIG. 5 showing another embodiment of the invention.

FIG. 6 shows a restrainer 25B made entirely of tough, durable sterilizable plastic such as nylon, as compared with the restrainer 25 shown in FIG. 5.

Figure 2:
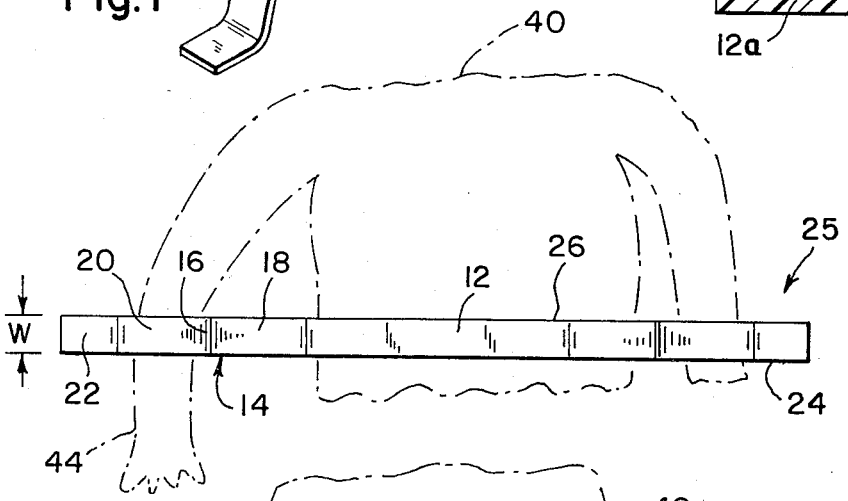
FIG. 2 is a top plan view of the restrainer of FIG. 1.
Figure 3:
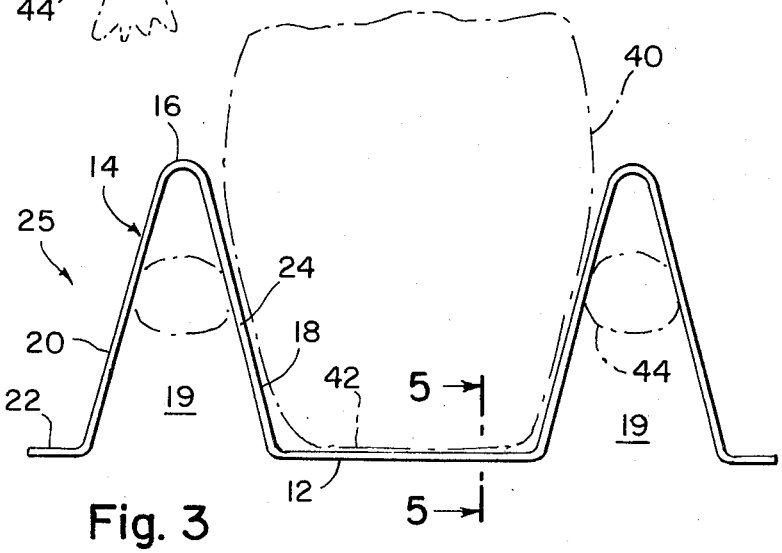
FIG. 3 is a side elevational view of the restrainer.
Figure 4:
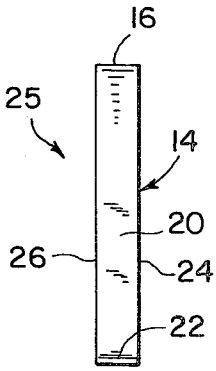
FIG. 4 is an end elevational view of the restrainer.

FIGS. 2 and 3 show in dot and dash lines part of an animal 40 lying on its back 42. The restrainer 25 is upright. The band 12 underlies the back of the supine animal exposing the abdomen of the animal. The forearms 44 of the animal are snugly engaged in the loops 19, defined by the bent legs 14. In this position, respiration of the anesthetized animal is unimpaired. Prior surgical restraints requiring the forearms to be stretched upward alongside the head of the animal, stretched the chest muscles and impaired respiration. The present restraining device prevents the animal from rolling over during ventral surgery. No conventional leather or fabric tie-downs are required. Another advantage of this restrainer is that the animal can be transported from the surgical table while still in the restrainer to a recovery bed or table. There the animal can be held post-operatively during recovery in the same restrainer.

Figure 7:
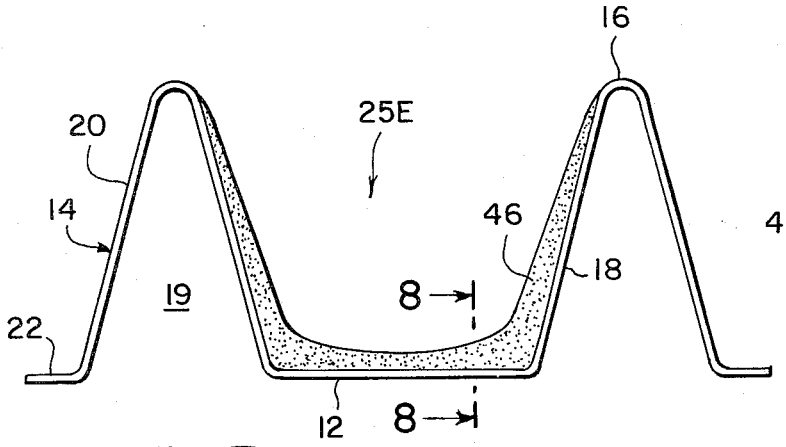
FIG. 7 is a side elevational view of a restrainer constituting a further embodiment of the invention.
Figure 8:
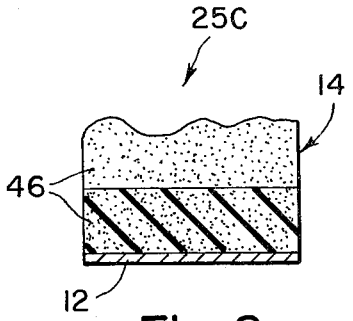
FIG. 8 is enlarged fragmentary sectional view taken along line 8—8 of FIG. 7.
Figure 9:
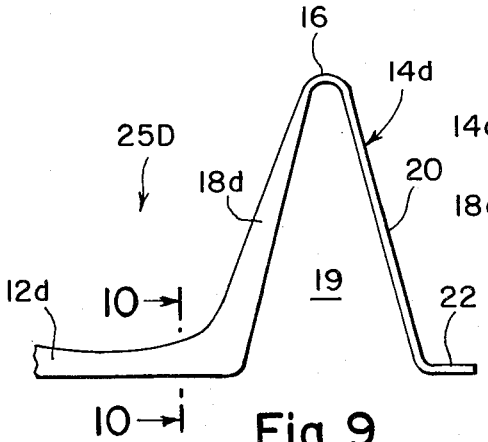
FIG. 9 is a fragmentary side elevational view of a restrainer embodying another form of the invention.

FIGS. 7 and 8 show a restrainer 25C embodying a modification of the invention. Here the band 12 and outer sides of inner side walls 18 of the restrainer 25C are lined with a contoured pad 46 made of foam rubber or plastic, which can be reinforced with fabric if desired. This lining pad 46 will conform more snugly to the form of the animal and will restrain the back and sides of the animal more comfortably.

Figure 10:
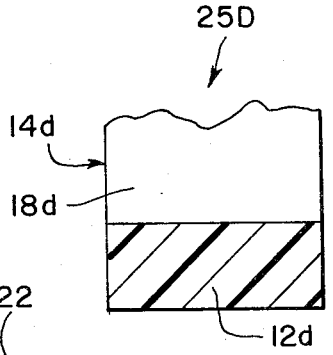
FIG. 10 is an enlarged fragmentary cross sectional view taken along line 10—10 of FIG. 9.

FIG. 10 shows a restrainer 25D in which the contoured cradle band **12*d* and legs 14*d* are all made of molded rigid plastic material, walls 18***d* are also cured on outer sides.

Figure 11:
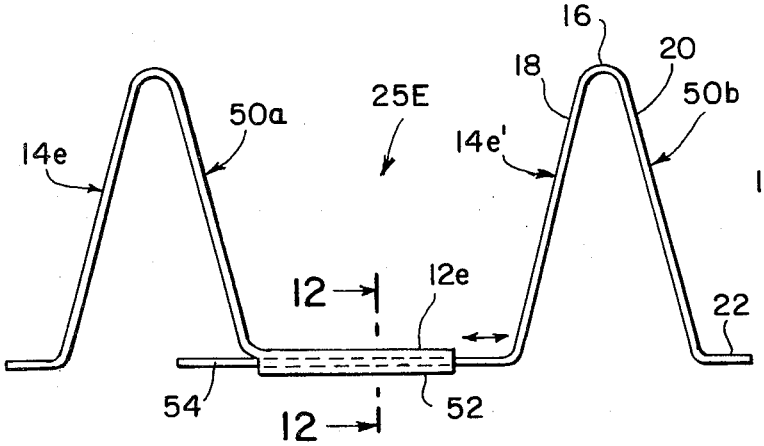
FIG. 11 is a side elevational view of a restrainer embodying a further form of the invention.
Figure 12:
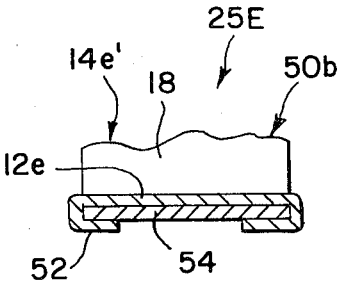
FIG. 12 is an enlarged fragmentary cross sectional view taken along line 12—12 of FIG.11.

FIGS. 11 and 12 show a restrainer 25E of two parts 50*a* and 50*b*. Part 50*a* has a channel shaped band portion 12*e* formed with two inturned bottom edges 52 which frictionally but slidably engage a band portion 54 of the part 50*b*. By the arrangement shown, legs 14*e*, 14*e*[1], can be adjustably separated so that the restrainer can be lengthened or shortened to accomodate animals of different cross sectional widths.

All the restrainers shown and described can be made by well known mass production metal and/or plastic working machinery at low cost. The restrainer may be made up and merchandised in sets of different sizes to accomodate animals of different sizes. They can be sterilized and cleaned for reuse many times. The restrainers described will be found to have great utility in operating rooms of animal hospitals and veterinarians, facilitating surgery and recovery of animals.

It should be understood that the foregoing relates to only a limited number of preferred embodiments of the invention, which have been by way of example only and that it is intended to cover all changes and modifications of the example of the invention herein chosen for the purposes of the disclosure, which do not constitute departures from the spirit and scope of the invention.

We claim:

1. A surgical restrainer for an animal, comprising:

an elongated structure having a central bottom band; and a pair of generally V-shaped inverted legs, each of said legs having inner and outer side walls defining a loop therebetween to receive a forearm of said animal, bottom ends of said inner side walls being joined with opposite ends of said band to define a cradle for said animal, said band being long enough to receive the body of said animal in supine position between said legs with forearms of said animal engaged in respective loops of said legs to prevent said animal from rolling over during surgery and post-operative recovery, and wherein said structure is sufficiently rigid so that said animal can be transported between a surgical table and recovery table while still engaged in said cradle.

2. A surgical restrainer as defined in claim 1, further comprising feet extending outwardly from bottom ends of said outer side walls of said legs, said feet being coplanar with said bottom of said band, said band and said feet being wide enough so that said structure can stand alone upright on a flat surface.

3. A surgical restrainer as defined in claim 1, further comprising a pad lining said band and adjacent side walls of said legs and contoured to conform to said body of said animal.

4. A surgical restrainer as defined in claim 1, wherein said structure is made entirely of tough durable rigid plastic material.

5. A surgical restrainer as defined in claim 1, wherein said structure is made entirely of one metal strip.

6. A surgical restrainer as defined in claim 5, wherein said strip is coated with smooth plastic material.

7. A surgical restrainer as defined in claim 1, wherein the upper side of said band and adjacent sides of said inner sides of said side walls are curved and contoured to conform to said body of said animal.

8. A surgical restrainer as defined in claim 8, wherein said structure is made entirely of tough, durable plastic material.

9. A surgical restrainer as defined in claim 1, wherein said band comprises elongated sections, engageable with each other, and adjustable lengthwise, to adjust spacing between said legs for receiving animals of different sizes in said cradle.

* * * * *